US008482898B2

(12) United States Patent
Honer et al.

(10) Patent No.: US 8,482,898 B2
(45) Date of Patent: Jul. 9, 2013

(54) ELECTRODE CONDITIONING IN AN ELECTROHYDRODYNAMIC FLUID ACCELERATOR DEVICE

(75) Inventors: Ken Honer, Santa Clara, CA (US); Guilian Gao, San Jose, CA (US); Nels Jewell-Larsen, Campbell, CA (US)

(73) Assignee: Tessera, Inc., San Jose, CA (US)

( * ) Notice: Subject to any disclaimer, the term of this patent is extended or adjusted under 35 U.S.C. 154(b) by 355 days.

(21) Appl. No.: 12/771,967

(22) Filed: Apr. 30, 2010

(65) Prior Publication Data

US 2011/0265832 A1 Nov. 3, 2011

(51) Int. Cl.
*H05F 3/00* (2006.01)

(52) U.S. Cl.
USPC ..... 361/225

(58) Field of Classification Search
USPC ..... 361/225
See application file for complete search history.

(56) References Cited

U.S. PATENT DOCUMENTS

| | | | |
|---|---|---|---|
| 4,318,718 | A | 3/1982 | Utsumi et al. |
| 5,084,077 | A | 1/1992 | Junker et al. |
| 5,160,351 | A | 11/1992 | Schmidt |
| 5,447,763 | A | 9/1995 | Gehlke |
| 5,726,524 | A | 3/1998 | Debe |
| 5,942,017 | A | 8/1999 | Van Winkle, Sr. |
| 6,168,491 | B1 | 1/2001 | Hsu et al. |
| 6,215,248 | B1 | 4/2001 | Noll |
| 6,603,268 | B2 | 8/2003 | Lee |
| 6,958,088 | B1 | 10/2005 | Moriyama |
| 7,115,153 | B2 | 10/2006 | Ahlborn et al. |
| 7,157,704 | B2 | 1/2007 | Krichtafovitch et al. |
| 7,488,375 | B1 | 2/2009 | Chen |
| 7,501,765 | B2 | 3/2009 | Curtis et al. |
| 7,517,505 | B2 | 4/2009 | Botvinnik et al. |
| 2005/0210902 | A1 | 9/2005 | Parker et al. |
| 2006/0018812 | A1 | 1/2006 | Taylor et al. |
| 2009/0274592 | A1 | 11/2009 | Bergeron |
| 2010/0236412 | A1 | 9/2010 | Meister |

FOREIGN PATENT DOCUMENTS

| | | | |
|---|---|---|---|
| DE | 19823342 | A1 | 12/1999 |
| EP | 0433152 | A1 | 12/1990 |
| WO | 9631281 | | 10/1996 |
| WO | 2006039562 | A2 | 4/2006 |

OTHER PUBLICATIONS

Kogoma, M. "Ozone, ammonia and NOx destruction in corona discharge tube coated with ozone catalyst." Thin Solid Films 381 (2001) 200-203.

*Primary Examiner* — Stephen W Jackson

(57) ABSTRACT

Conditioning an electrode is performed with a cleaning device for removing detrimental material from forming electrode surfaces of an electrohydrodynamic device or other ion flow generating device. A conditioning material is deposited on the electrode to at least partially mitigate erosion, corrosion, oxidations, dendrite formation on the electrode or ozone production. The conditioning material can be deposited by a wearable portion of one or more cleaning blocks or wipers. The cleaning blocks may have a composition selected to be hard enough to remove detrimental material under a selected pressure, while soft enough to be wearable to deposit a conditioning layer on the electrode surface. The conditioning material can be applied as a solid or liquid. The applied conditioning material can include at least one of silver, palladium, platinum, manganese, nickel, zirconium, titanium, tungsten, aluminum, oxides or alloys thereof, carbon, and organometallic materials that decompose under plasma conditions.

35 Claims, 9 Drawing Sheets

ELECTRODE CONDITIONING IN AN ELECTROHYDRODYNAMIC FLUID ACCELERATOR DEVICE

BACKGROUND

Technical Field

This application relates generally to in situ conditioning of electrodes in electrohydrodynamic or electrostatic devices such as electrohydrodynamic fluid accelerators and electrostatic precipitators.

Many electronic devices and mechanically operated devices require air flow to help cool certain operating systems by convection. Cooling helps prevent device overheating and improves long term reliability. It is known to provide cooling air flow with the use of fans or other similar moving mechanical devices, however, such devices generally have limited operating lifetimes, produce noise or vibration, consume power or suffer from other design problems.

The use of an ion flow air mover device, such as an electrohydrodynamic (EHD) device or electro-fluid dynamic (EFD) device, may result in improved cooling efficiency, reduced vibrations, power consumption, electronic device temperatures, and noise generation. This may reduce overall device lifetime costs, device size or volume, and may improve electronic device performance or user experience.

In many EFA and EHD devices and other devices using emitter or collector electrodes, detrimental material such as silica dendrites, surface contaminants, particulate or other debris may accumulate or form on electrode surfaces and may decrease the performance, efficiency and lifetime of such devices. In particular, siloxane vapor breaks down in the plasma or corona environment and forms solid deposits of silica on the electrode, e.g., emitter or collector electrode. Such silica contaminant build-up can decrease power efficiency, cause sparking or reduce spark-over voltage and contribute to device failure.

Accordingly, improvements are sought in cleaning and conditioning electrode surfaces.

SUMMARY

Devices built using the principle of the ionic movement of a fluid are variously referred to in the literature as ionic wind machines, electric wind machines, corona wind pumps, electro-fluid-dynamics (EFD) devices, electrohydrodynamic (EHD) thrusters and EHD gas pumps. Some aspects of the technology have also been exploited in devices referred to as electrostatic air cleaners or electrostatic precipitators.

In the present application, implementations of the devices illustrated and described herein are referred to as electrohydrodynamic fluid accelerator devices, and are suitable for use as a component in a thermal management solution to dissipate heat generated by an electronic circuit, amongst other things. Some implementations are described in the context of an electrostatic precipitator device.

It has been discovered that it is possible to condition an electrode of an EFA, EHD or similar ion motive or flow generating device to inhibit deposit or detrimental material buildup and facilitate deposit removal due to low adhesion of the deposit to the conditioned electrode surface. It has further been discovered that the presence of carbon during dendrite formation causes the dendrites to have a lower adhesion to formation surfaces. Carbon may be provided via application of a conditioning material to the electrode or via introduction of the carbon into the environment around the electrode. In some cases, a carbon bearing cleaning device such as a wiper, brush or squeegee serves to remove detrimental materials built up on the electrode and to further deposit a carbon coating or other conditioning material on the electrode to reduce surface adhesion and facilitate subsequent detrimental material removal.

In some implementations a corrosion resistant layer may be formed during mechanical cleaning of an electrode. In some implementations, a carbon material, such as graphite, provides resistance to oxidation and other effects of ion bombardment, e.g., in a plasma environment, or and may also lubricate the electrode to prevent damage to the surface metal coating. A sacrificial conditioning coating can protect underlying metals from ion bombardment or plasma erosion. The carbon coating also provides a low adhesion surface coating to resist deposit adhesion. Preferably, a cleaning device hardness is selected to achieve effective removal of detrimental material without damaging an underlying metal electrode coating. Periodic or repeated conditioning can reduce or prevent gradual buildup of detrimental materials or oxidation of the electrode.

In some implementations, a device includes an electrode energizable with respect to at least one other electrode to generate or motivate ions and to thereby motivate fluid flow, and a cleaning device positioned to frictionally engage at least a portion of a surface of the electrode. One of the cleaning device and the electrode is movable relative to the other to remove detrimental material from the electrode while an electrode conditioning material is deposited on the electrode in situ via movement of one of the cleaning device and the electrode.

In some cases, the conditioning material is depositable via one of a wearable layer, wearable pad, and wearable insert on the cleaning device.

In some implementations, the cleaning device comprises first and second opposed cleaning blocks in contact with the electrode. In some cases, the cleaning blocks define a substantially nonlinear electrode guide to thereby elastically deform the electrode during movement of one of the cleaning device and the electrode.

In some implementations, the conditioning material includes an ozone reducer, e.g., catalyst, activated charcoal, or other material selected to break down or combine with ozone. In some implementations, the conditioning material is selected to at least partially mitigate at least one of electrode erosion, corrosion, oxidation, silica adhesion, dendrite formation or mechanical adhesion of other detrimental material. In some cases, the conditioning material includes at least one of silver, palladium, platinum, manganese, nickel, zirconium, titanium, tungsten, aluminum, oxides or alloys thereof, carbon, and organometallic materials that decompose under plasma conditions or under ion bombardment.

In some cases, at least a leading portion of the cleaning device is constructed to clean the electrode and at least a trailing portion of the cleaning device comprises a wearable bulk of conditioning material. In some cases, the cleaning device defines one or more channels bearing the conditioning material.

In some cases, the electrode is one of a collector electrode and an emitter electrode. In some cases the electrode or the cleaning device is moveable in response to one of detection of an event and a change in measured device operating parameters.

In some applications, the invention features a method of conditioning an electrode energizable to generate or motivate ions and to thereby motivate fluid flow. The method includes positioning a cleaning device to frictionally engage at least a portion of a surface of the energizable electrode. The method further includes moving at least one of the cleaning device and the electrode to thereby remove detrimental material from the electrode; and depositing, in situ, an electrode conditioning material on the electrode.

In some applications, the electrode conditioning material includes an ozone reducer, e.g., a catalyst or material combinable with ozone. In some applications, the deposited conditioning material forms a sacrificial coating selected to mitigate electrode oxidation in a plasma environment or from ion bombardment. For example, silver oxide may serve both to as a sacrificial coating and to reduce ozone.

In some cases, the conditioning material is deposited by the cleaning device via movement of at least one of the cleaning device and the electrode.

In some cases, the conditioning material comprises a liquid supplied to the cleaning device during the moving.

In some applications, depositing the conditioning material comprises wicking the conditioning material onto a surface of the electrode. In some cases, the method includes heating the electrode during the wicking. In some cases, heating the electrode is performed using a power supply and controller to modify at least one of a composition, phase, morphology and surface adhesion of a deposited conditioning material.

In some implementations, the device is incorporated into an electronic apparatus including a controller operable to initiate movement of one of the cleaning device and the electrode to thereby deposit the conditioning material on the electrode.

In some implementations, the conditioning material forms a carbon coating selected to inhibit contamination buildup or to provide low adhesion properties to facilitate removal of detrimental materials. The use of carbon or carbon containing material coatings on the surface of an electrode may reduce the adhesion of the detrimental materials to the electrode, and may result in improved removal of detrimental material from the electrode.

In some implementations, a carbon bearing mechanical cleaning device is used to clean an electrode. In some cases, the cleaning device includes a brush. In some cases, the cleaning device includes a squeegee or wiper. In some cases, the cleaning device is configured and arranged to engage the electrode to mechanically remove detrimental materials built-up on the electrode. The brush or squeegee bearing the carbon is further configured and arranged to deposit a portion of the carbon on the electrode during the cleaning.

In some cases, deposition of the carbon on the electrode renews a carbon coating on the electrode. The carbon coating reduces adhesion of dendrites or other detrimental material to the electrode and facilitates subsequent removal of build-up of such detrimental materials.

The deposited carbon, e.g., graphite or other soft carbon material, can also provide lubrication during subsequent mechanical cleaning. In particular, this lubrication protects the surface metal coating of the electrode from mechanical abrasion during cleaning. Thus, the carbon coating and surface metal coating protect the underlying metals in the plasma environment and during cleaning operations.

In some implementations, the mechanical cleaning device is configured to maintain a predetermined thickness of a conformal layer on the electrode. For example, the mechanical cleaning device can be configured to remove or apply the conformal layer to achieve a target conformal layer thickness. The conformal layer presents a silicon-phobic surface that inhibits deposit adhesion. The conformal layer can also mitigate erosion of the underlying metal coating.

In some implementations, the mechanical cleaning device includes two complementary cleaning blocks frictionally engaging the electrode. In some cases, the blocks are subject to a clamping or applied force retaining the blocks in contact with the electrode. In a particular implementation, the clamping force is generated by a spring wrapped about the cleaning blocks. In some cases, the cleaning blocks form a split annulus and the clamping force is provided by a coil spring wrapped about the annulus.

In some cases, the cleaning device includes complementary cleaning blocks with a first cleaning surface, e.g., a fixed leading edge profile, and a conditioning surface along a central or trailing portion of the cleaning blocks. In some cases, the cleaning and conditioning are performed by the same cleaning device surfaces.

In some implementations, the cleaning device is configured to remove detrimental material in at least a first direction of travel and to condition the electrode with a conformal layer in at least a second direction of travel. For example, the cleaning blocks can contact the electrode with a first cleaning contact surface under a first force in a first direction of travel and contact the electrode with a second wearable conditioning material surface under a second force in a second direction of travel. Thus, in some cases, the cleaning and conditioning operations are dependent on the direction of travel of the cleaning device along the electrode.

In a particular implementation, a degree of cleaning block contact or pressure can be directionally variable, e.g., to maintain a tight tolerance profile travelling in a first direction and to be spaced apart travelling in a second direction. Thus, in some cases, one or both of the cleaning blocks are urged or held to frictionally engage the electrode with a first set of complementary cleaning block surfaces in a first direction of travel and to frictionally engage the electrode with a second set of complementary cleaning block surfaces in a second direction of travel. In a particular case, directional frictional resistance between the cleaning block and the electrode can urge the cleaning blocks to move between cleaning and conditioning positions.

Any dust, dendrite growth or other detrimental material on electrodes may be removed by using a brush, a wiper or bead that travels along the electrode. In some cases, the brush, wiper or bead may be made of a soft material such as a polymer to prevent abrasion of the electrode.

In some implementations, the first electrode and the other electrode constitute at least a portion of a thermal management assembly thermally coupled to a heat dissipating device in an electronic device. In some case, at least one of the first electrode and the cleaning device is moveable in response to detection of one of a low thermal duty cycle, power on cycle and a power off cycle of the electronic device.

In some implementations, the electrode and cleaning device are incorporated into one of a computing device, photocopier, printer, and air purifier.

The detailed description refers to the accompanying drawings that show, by way of illustration, specific aspects and implementations in which the present disclosed teaching may be practiced. Other arrangements and implementations may also be utilized, and structural, logical, and electrical changes may be made without departing from the scope of the disclosed implementations. The various implementations are not necessarily mutually exclusive, as some implementations can be combined with one or more other implementations to form new implementations.

DETAILED DESCRIPTION

Figure 1:
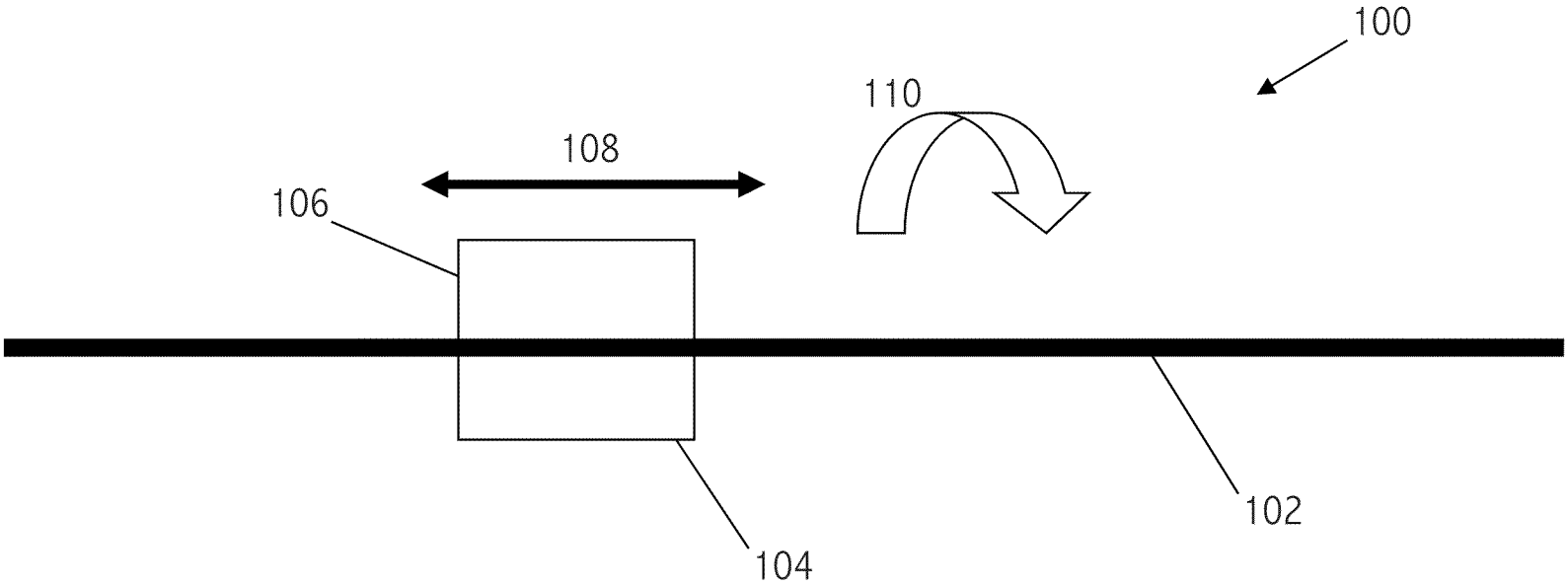
FIG. 1 depicts a side view of an electrode with a sliding cleaning device, in accordance with various implementations.

The use of EFA or EHD air cooling systems or similar devices may result in reduced vibrations, electronic device temperatures, and noise generation than may be found in mechanical air cooling systems such as fans. In some cases, device efficiency may be affected by detrimental material such as silica dendrites, surface contaminants, particulate or other debris that may cause voltage changes, electrical arcing, and loss of power in air flow efficiency. Cleaning the electrode may reduce these problems, improve lifetime operating costs, and improve efficiency.

In some implementations a cleaning device, e.g., a wiper, may be held and/or moved against the electrode with a pressure to mechanically remove the detrimental material while not abrading or otherwise damaging the electrode. In some cases, the electrode is moved past the wiper. The wiper may have a composition selected to be hard enough to remove the detrimental material under the selected pressure, and yet soft enough to not harm the electrode. The wiper or a separate conditioning device deposits a conditioning material on the electrode. For example, the wiper may include a wearable bulk of conditioning material to leave a low adhesion or non stick layer on the electrode surface during the conditioning process. In some cases, the conditioning material composition may be selected to form a partially conductive layer on the electrode. In some cases, the conditioning material may be selected to at least partially mitigate erosion, corrosion, dendrite formation, oxidation and ozone.

The applied conditioning material layer may be conformal to the electrode surface or may partially coat the surface and smooth the surface. The layer may provide electrode erosion control, reduce the detrimental material and dendrite formation rate, and reduce sharp points that may cause electrode arcing. The layer may be formed of a carbon containing compound selected to inhibit contamination buildup and facilitate the removal of contamination buildup due to the generally low adhesion of carbon surfaces.

In various implementations, cleaning and/or conditioning may be done with a brush, rotating brush, compliant or conformal surface, or an edge such as a squeegee or wiper blade, or with a material having sufficient softness to not abrade, scratch or damage the surface of the electrode.

In some implementations, the carbon coating may be applied during cleaning by using a wearable carbon wiper blade, thus removing detrimental materials at the same time as forming or renewing a conditioning coating. The lubricating effect of the soft carbon material (for example graphite) may also further reduce damage to the electrode during wiping and during operation under ion bombardment, e.g., in a plasma environment such as found in corona devices.

The cleaning device or wiper may be formed of two or more cleaning blocks that are urged against at least part of the electrode surface. For example, in some cases, the electrode is a wire and the cleaning blocks may include graphite inserts or graphite layers on the cleaning blocks. The cleaning blocks may be pressed towards each other on opposite sides of the wire, and the motion of the wire electrode against the blocks may wear the graphite to form a partial layer of carbon on parts of the wire.

In a particular case, the wire may be substantially wiped and conditioned by rotating or spiraling the graphite conditioning material bearing blocks around the circumference of the wire while travelling along the length of the wire. As wiping operations occur at selected intervals, a groove may be worn into the wearable conditioning material on the blocks, such that the blocks may eventually contact each other around the wire. The wearable conditioning portion or the entire cleaning blocks may be replaced as needed. Alternatively, in some implementations, the cleaning blocks may be compliant such that an applied pressure on the blocks causes the block to deform around the wire.

With reference to FIG. 1, one implementation of a cleaning system 100 includes an electrode 102 and a mechanical cleaning device or "wiper" including two opposed cleaning blocks, 104 and 106, on opposite sides of the electrode 102. The invention is not limited to two part cleaning devices as shown in the figure, but may include single piece sliding cleaning devices such as shuttles, beads, brushes, or multiple cleaning heads and surfaces. The electrode is not limited to wire electrodes and may include planar electrodes, elongated electrodes and other shaped electrodes.

The cleaning device comprising portions 104/106 may be moved in contact with the electrode 102 in a linear motion 108, or a rotating motion 110, or a combination of motions, either simultaneously or sequentially. For example, cleaning blocks 104/106 may be translated or otherwise driven by a carriage moveable along a length of electrode 102, as described with reference to FIG. 10 below.

Alternatively, electrode 102 may be transited past cleaning blocks 104/106. Thus, detrimental material removal and/or electrode conditioning (collectively "cleaning") may be accomplished by movement of either of the electrode 102 and/or cleaning blocks 104/106. For example, electrode 102 may be an endless loop trained about a drive pulley. Alternatively, in some cases, worn or contaminated electrode may be periodically renewed by new wire lengths drawn from a supply spool and the used lengths collected on a take-up spool. In some cases, new electrode lengths may be provided by other feed mechanisms or may simply be manually replaced. A new electrode may be provided after a fixed number of cleaning cycles, after a predetermined period of use or upon detection of deterioration of performance. Thus, an actuator may be used to move at least one of the electrode and the cleaning blocks.

In some implementations, the cleaning/conditioning is performed when the electrode is not in use. Alternatively, the cleaning action may be performed continuously or at timed intervals. In some cases, conditioning or cleaning may be initiated by a controller based upon one or more of an imposed voltage level, a measured electrical potential, determination of the presence of a level of contamination by optical means, be detection of an event or performance parameter, or other methods indicating a benefit from mechanically cleaning the electrode 102.

Figure 2:
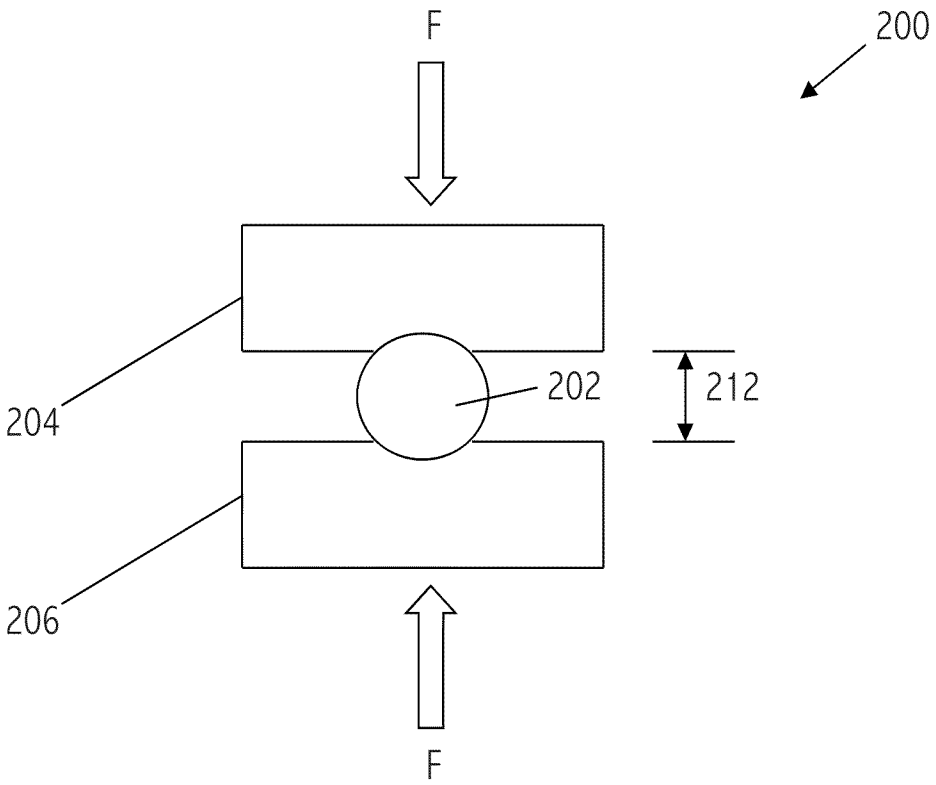
FIG. 2 illustrates an end on cross sectional view of the device of claim 1, showing an implementation of the cleaning device, in accordance with various implementations.

FIG. 2 illustrates an end on cross-sectional view of a cleaning system 200 with an electrode 202, with one or both of the cleaning blocks or portions 204 and 206 of a cleaning device being pressed onto the electrode 202 with an applied force F. Applied force F may be provided by springs, compressible foam, magnetic repulsion, fringing fields, solenoids, electrical repulsion, or any other means of providing a selected contact force between cleaning blocks 204/206 and electrode 202. Force F may be applied at a selected time with a selected pressure. For example, in a particular case, a foam backing plate connecting one of cleaning blocks 204/206 to a carriage or other support structure may urge the corresponding block against electrode 204 or the opposing block.

It may be seen that block 204 need not contact block 206 in the illustration. In the case of the blocks 204 and 206 being formed of a wearable or relatively soft material such as graphite, the operation of the cleaning device 200 under the pressure resulting from applied force F may result in the removal of some of the block material in the area adjacent to the electrode 202, resulting in a groove forming or deepening in the two blocks as shown. For example, cleaning blocks 204 and 206 may be separated by a spacing 212 that is reduced over time, with the blocks eventually contacting each other.

Thus, the efficacy of removal of detrimental material from or deposition of conditioning material on the surface of the electrode 202 may diminish over time. At this point the user may replace one or both of blocks 204 and 206, or any portion thereof, e.g., a wearable conditioning material insert or pad. Alternatively, block life may be prolonged, in some cases, using a compliant block material such that the applied pressure on the block causes the block to deform around the electrode.

It may be noted that moving the blocks 204 and 206 in the linear fashion shown in FIG. 1 reference numeral 108, along the length of the electrode 202 (i.e., into and out of the page in FIG. 2), may not completely remove all detrimental material, debris, contamination or dendrites on the surface due to the space between the two blocks. In some cases, it may be desirable to use a circular motion 110 as in FIG. 1 in conjunction with the linear motion 108, to provide more comprehensive coverage of the electrode.

Figure 3:
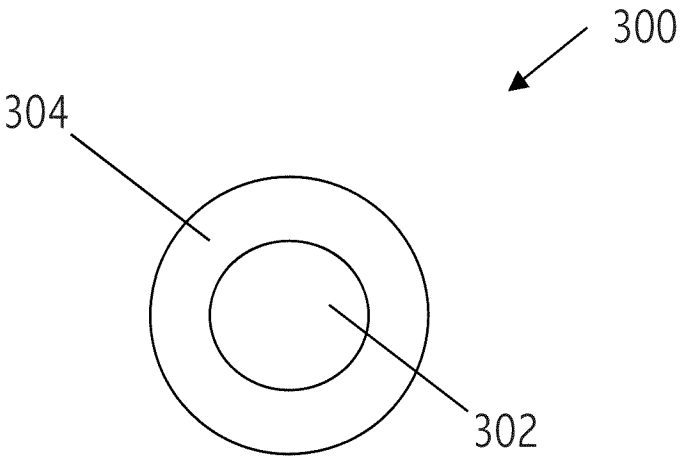
FIG. 3 illustrates a cross sectional view of an implementation of a conditioning material coating on an electrode, in accordance with various implementations.

FIG. 3 illustrates a cross sectional view of the electrode with a carbon conditioning material coating 304 formed, for example, by a soft carbon block sliding either linearly in direction 108 of FIG. 1, or in a rotary fashion 110 of FIG. 1, around the electrode 302. In this implementation, the cleaning blocks (not shown) further serve as a conditioning surface leaving a conditioning material coating 304 on the electrode 302. The coating 304 is shown as a single layer, but the invention is not so limited, and may be a plurality of layers, each one formed during sequential cleaning operations as previously discussed.

The coating 304 may be formed of multiple conditioning materials or of multiple conditioning material layers by use of multiple wiper blades, cleaning blocks and/or multiple conditioning material surfaces. In a particular case, multiple cavities or channels defined in a cleaning block retain conditioning materials for deposition on the electrode. The material of the coating may be a uniform material, multiple layers of different materials, a material formed by the combination of two different materials wiped onto the electrode 302, or a material formed by chemical action or by plasma action.

In some cases, the conditioning material sublimates from a solid phase to a vapor phase in response to heating of the conditioning material.

In some implementations, the conditioning material is applied by wicking onto the electrode, for example, using capillary channels formed in a cleaning block. Alternatively, the electrode itself may wick the conditioning material from a reservoir or other source along a portion of the electrode and the cleaning blocks may further spread the conditioning material along the electrode. Such wicking and spreading may be aided by heating the electrode.

The conditioning material layer 304 provides a sacrificial layer or protective coating. The coating need not be continuous over the entirety of the operating surface of the electrode 302. In some cases, the coating may provide low adhesion or a "non stick" surface, or it may have a surface property that repels silica, which is a common material in dendrite formation. As an illustrative example, the conditioning material layer 304 may include carbon such as graphite, and may reduce adhesion of dendrites and other detrimental materials, and may reduce their formation rate as well as improve the ease of mechanically removing any contamination. Conditioning material layer 304 may serve as a sacrificial layer that is oxidized or eroded by a plasma environment. Replenishment of this sacrificial layer provides erosion protection for the underlying electrode metal, such as tungsten, or another electrode protective coating that may otherwise be eroded or thinned.

In some implementations, the material of the layer 304 may be selected to have an ozone reduction function, e.g., to reduce ozone generated by the device. As an illustrative example, a material that includes silver (Ag) may be used to reduce ozone in an air flow. Silver may also be used to prevent silica growth.

Reapplication of the layer 304 during wiping operations may be controlled via the applied pressure and composition of the wiping surface to form a coating with a thickness approximately equal to an erosion thickness. Thus, the conditioning material layer 304 may be repeatedly eroded and reformed.

Figure 4:
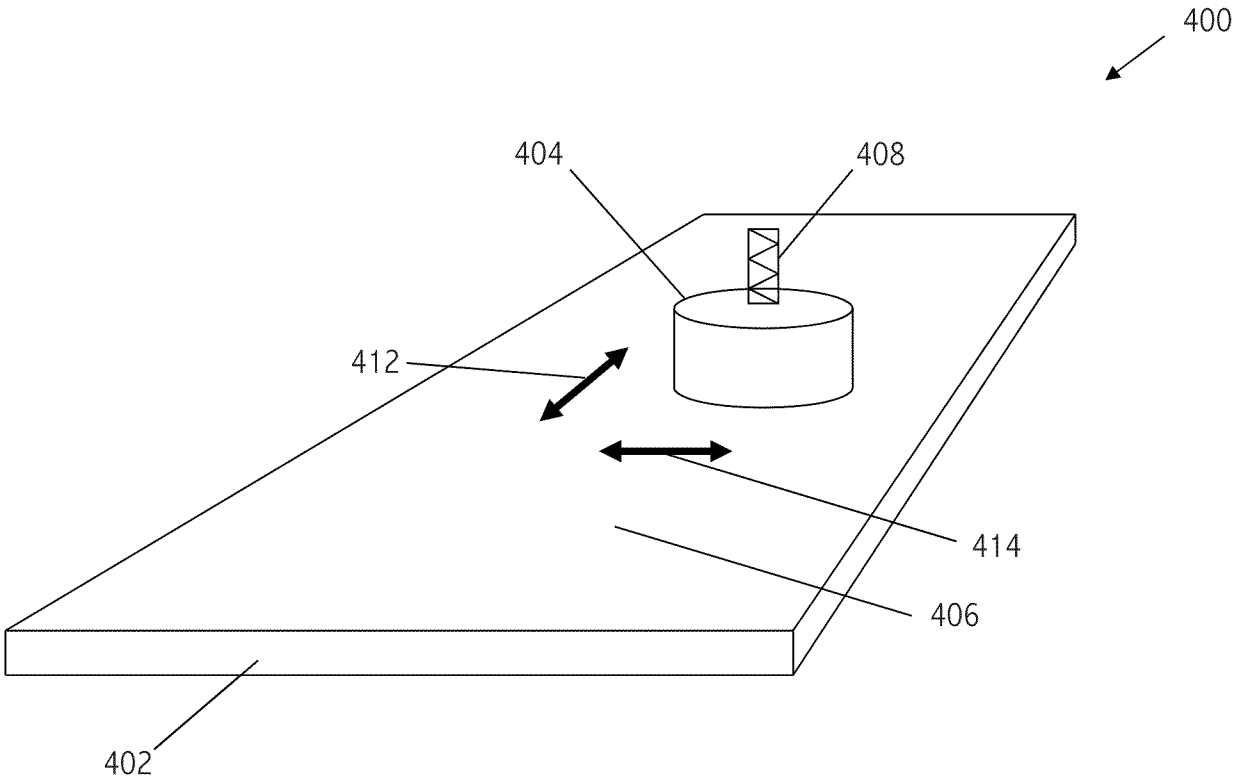
FIG. 4 illustrates a planar electrode with a cleaning device, in accordance with various implementations.

FIG. 4 illustrates a planar electrode 402 having a sliding cleaning device 404. The sliding cleaning device 404 may comprise a conditioning material, e.g., soft carbon containing material such as graphite that may deposit a layer 406 (not separately shown for simplicity of understanding) on a portion of the surface of the electrode 402. The conditioning material may be a wearable layer, e.g., a graphite pad, insert or layer. Alternatively, cleaning device 402 can comprise major components formed substantially of conditioning bulk material, e.g., a solid wearable graphite cleaning block as previously discussed.

The cleaning device 404 may have any shape and is not limited to the cylindrical shape shown. The cleaning device 404 may be removed from the surface, placed and urged against the surface of electrode 402 by a pressure device 408. The cleaning device 404 may be movable in any combination of motions 412 and 414 to cover any selected portion of the electrode 402. Various combinations of motions 412 and 414 may be linear, reciprocating, circular or elliptical. The shape of the electrode 402 is shown as planar, but the invention is not so limited and is adaptable to any shape of electrode.

With reference to FIGS. 5-9, the cleaning blocks can be constructed or arranged to elastically deform or deflect the electrode during cleaning, for example, via a nonlinear contour of a cleaning/conditioning block or of an electrode guide or other suitable electrode contact feature. In some implementations, the electrode is clamped between two conditioning pads or cleaning blocks, each of which define complementary surfaces for deflecting the electrode into a controlled bend. The radius of the bend is selected to avoid plastic deformation of the electrode. For example, the electrode diameter and bend radius are selected such that a ratio of the electrode radius to a bend radius does not exceed the yield strain of the electrode material. The complementary surfaces can include multiple undulations inducing controlled bending stress in the electrode to break up brittle silica deposits on the electrode. Deflection of the electrode also helps maintain contact between the electrode and the conditioning pads/cleaning blocks as they wear.

Figure 6:
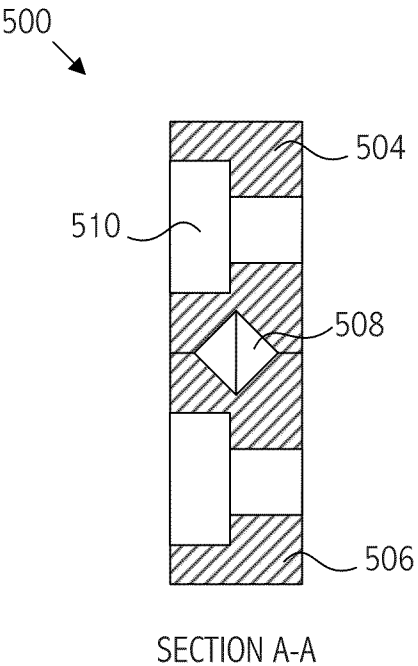
FIG. 6 illustrates a cross-sectional view of the cleaning blocks of FIG. 5.
Figure 5:
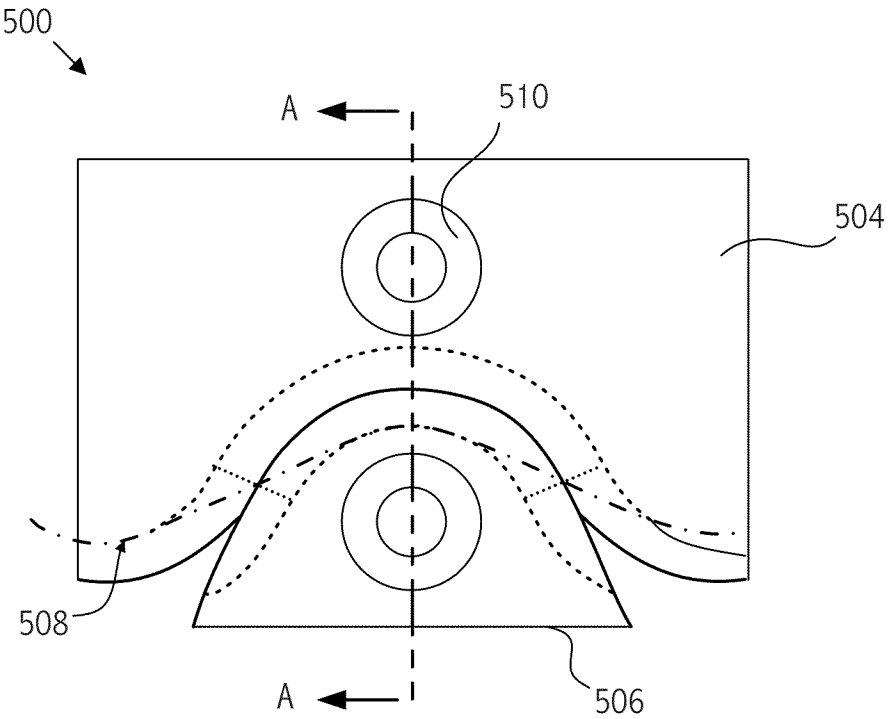
FIG. 5 illustrates cleaning blocks for conditioning an electrode, in accordance with various implementations.

With reference to FIG. 5 and the cross-sectional view of FIG. 6, a mechanical cleaning device or "wiper" 500 includes a first cleaning block 504 and an opposing second cleaning block 506 for contacting an electrode. Blocks 504 and 506 together define a nonlinear electrode guide 508 or path providing elastic deformation of an electrode and frictional cleaning contact on obverse electrode surfaces. During cleaning and conditioning, an electrode passes through electrode guide 508 as either the electrode or the cleaning blocks are transited past the other. Electrode guide 508 is depicted in cross-sectional view as defining a channel sized to receive an electrode therein.

In some instances, elastic deformation of the electrode can increase cleaning or conditioning efficacy or control. For example, a degree of deformation of the electrode or a degree of friction at certain points of contact may be controlled to vary cleaning and conditioning parameters. Tension in the electrode or pressure or spacing between cleaning blocks 504/506 may be variable in some cases. For example, cleaning blocks 504/506 may initially be spaced a distance apart and may then gradually move closer together and contact as the blocks wear from extended cleaning and conditioning cycles.

Cleaning blocks 504/506 may be formed of a wearable material including a conditioning material composed to reduce adhesion, reduce ozone, mitigate oxidation or otherwise mitigate adverse effects of ion bombardment or a plasma environment. In a particular implementation, blocks 504/506 are formed of a substantially sold, wearable graphite conditioning material. In some implementations, the wearable conditioning material is substantially softer than the electrode plating to avoid plating damage during cleaning/conditioning. In some cases, conditioning material compositions can include silver, platinum, manganese, palladium, nickel, or oxides or alloys of the same. In some cases, the condition composition includes carbon, organometallic materials that decompose under plasma conditions, and combinations thereof.

In some implementations, blocks 504/506 are formed of different materials or include different conditioning materials. For example, one block may bear a felt cleaning material while the other block includes a wearable graphite conditioning material. In some implementations, cleaning blocks 504/506 both include harder carbon wiping and conditioning materials. In some implementations, at least one of cleaning blocks 504/506 includes a softer wiper material, e.g., a felt pad or mohair.

Cleaning blocks 504/506 are depicted as defining apertures 510 for receiving fasteners to install blocks 504/506. Blocks 504/506 may be positionally fixed within a device and the electrode transited therebetween, e.g., as an endless electrode loop trained about a drive pulley. Alternatively, blocks 504/506 may be attached, e.g., as a fixture, to a movable carriage (see FIG. 10) for transiting cleaning blocks 504/506 relative to the electrode.

With reference to FIG. 6, cleaning blocks 504/506 are shown in contact along edge portions thereof. In some implementations, cleaning blocks 504/506 may be in contact on one or both sides of the electrode during cleaning/conditioning operations. Alternatively, contact between the cleaning blocks may be used to indicate an end of life state for worn cleaning blocks in some implementations.

With reference to FIG. 6, one or both cleaning blocks may be allowed to partially rotate about an attachment fastener inserted through fastener passage 510 such that friction or pressure from an electrode can cause a degree of rotational movement of the corresponding cleaning block. For example, a pivot point can be positioned on a cleaning block to create a first cleaning profile of electrode guide 508 in a first direction of travel and second conditioning profile of electrode guide 508 in a second direction of travel. Thus, cleaning blocks 504/506 may be moveable or otherwise variable between discrete cleaning and conditioning positions. Alternatively, cleaning blocks 504/506 can be fixed and provide for simultaneous cleaning and conditioning operations in single or multiple passes.

Figure 7:
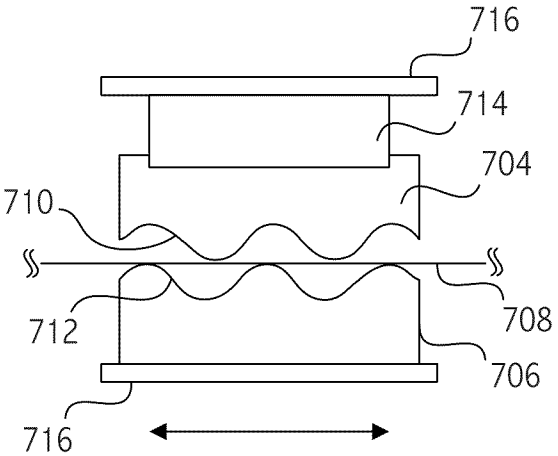
FIG. 7 illustrates cleaning blocks for conditioning an electrode, in accordance with various implementations.

With reference to FIG. 7, cleaning blocks 704/706 define complementary opposed surfaces 710 and 712. Surfaces 710 and 712 can include ridges and grooves or channels transverse to a longitudinal orientation of electrode 708 (i.e. into the page). In some implementations, such channels can serve as reservoirs or conduits for conditioning materials to be applied to electrode 708. For example, a substantially solid wearable conditioning material may be disposed in channels or other recesses formed in one or both of surfaces 710 and 712.

Alternatively, a substantially liquid or flowable conditioning material may be dispensed to channels formed in one or both of surfaces 710 and 712 during conditioning operations. In some cases, heat can be used to render a conditioning material flowable or to alter the composition of the conditioning material before or after application to electrode 708.

In some implementations, a cleaning block can bear different materials for coating the electrode. In some implementations, the cleaning blocks define multiple channels for conveying materials to be applied to the electrode. For example, a first cleaning block channel or area can include a binder and a second channel or area can include graphite. In some cases, a binder and/or carbon bearing liquid may be injected into adjacent channels to thereby be sequentially deposited on an electrode passing by a portion of the channel as the cleaning block travels along the electrode or as the electrode is transited past the cleaning block. Accordingly, in some cases, a conditioning material may be replenished without the need to replace a cleaning block or a conditioning portion of the cleaning block.

In some cases, the binder and/or graphite may be in the form of inserts or pads disposed on the cleaning block. In some cases, the binder and/or graphite may be in the form of coatings applied to different areas of the cleaning block. In a particular case, the binder is oxidized leaving a residual conditioning material, e.g., a paraffin binder leaves a graphite residue or a solvent evaporates to leave a silver or manganese residue. In some cases, different coating materials may be positioned on a cleaning block to be sequentially applied to the electrode during single or multiple cleaning block cleaning movements.

Pressure can be provided between blocks 704/706 by a foam block 714 or spring disposed between at least one of the cleaning blocks 704/706 and a corresponding support structure, e.g., carriage arm 716. Cleaning blocks 704/706 and foam block 714 are arranged to provide pressure between cleaning blocks sufficient to frictionally clean electrode 708, which can also be deflected thereby for cleaning or conditioning.

Figure 8:
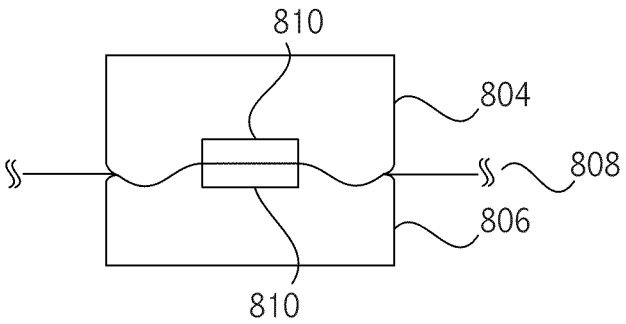
FIG. 8 illustrates cleaning blocks bearing a conditioning material insert for conditioning an electrode, in accordance with various implementations.

With reference to FIG. 8, cleaning blocks 804/806 include a conditioning material insert 810 for conditioning an electrode 808. Conditioning material inserts 804/806 are centrally positioned on cleaning blocks 804/806, such that cleaning is performed primarily at the corresponding leading edge of cleaning blocks 804/806 and conditioning is performed as the electrode 808 passes over conditioning material inserts 810.

Conditioning material inserts 810 may be removable and replaceable as needed, or may be integral with and replaceable with cleaning blocks 804/806 as needed. Conditioning material inserts 810 can include similar or different conditioning material compositions. For example, one conditioning material composition can provide an electrode shielding composition to protect against oxidation, and another conditioning material composition can include an ozone reducer. In some implementations, conditioning material compositions include a low adhesion or silicon-phobic material. In some implementations, conditioning material compositions include an organic material. In some cases, the organic material is carbon. In some cases, a conditioning material forms a sacrificial layer that inhibits dendrite formation or adhesion of detrimental materials.

Figure 9:
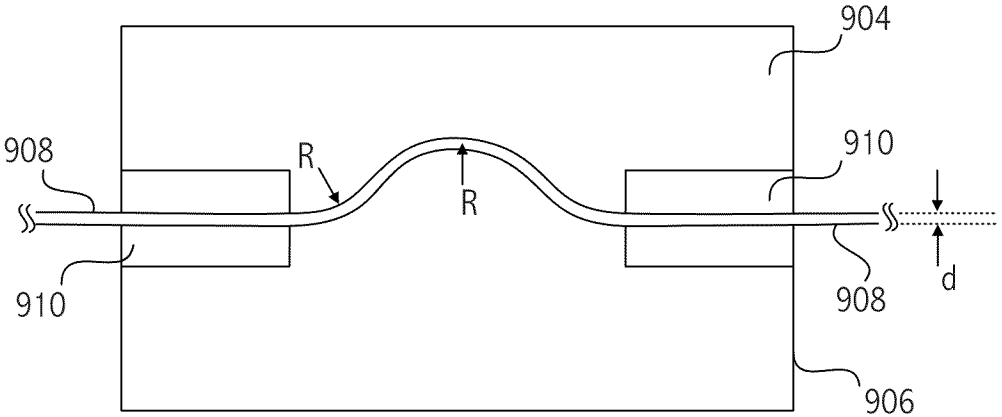
FIG. 9 illustrates cleaning blocks bearing conditioning material inserts for conditioning an electrode, in accordance with various implementations.

With reference to FIG. 9, conditioning material inserts 910 are positioned at outward leading and trailing edges of cleaning blocks 904/906 for conditioning electrode 908. This arrangement of conditioning material inserts 910 can be advantageous, for example, in providing a lubricating graphite conditioning material prior to deflection and frictional cleaning of electrode 908 along a central portion of cleaning blocks 904/906.

In some implementations, the cleaning blocks can include multiple cleaning or conditioning regions or surfaces. In some cases, the cleaning blocks each include at least a first region for removing dendrites from the electrode through scraping or frictional cleaning, and at least a second region for depositing a conditioning material coating on the electrode. In some cases, the cleaning and conditioning are simultaneously performed by movement of the cleaning device. The cleaning blocks may include any combination of surface profiles, including flat, curved, grooved, undulating, and the like to provide a desired degree of frictional contact and/or electrode deflection during cleaning.

Similarly, the electrode may be formed as a block, strip, or other form and the cleaning block can be constructed to contact any desired portion of the electrode. In some cases, the cleaning block may generally conform to the electrode to provide detrimental material removal across all or a major portion of the electrode. For example, the cleaning block can be constructed as a ring or cylinder enclosing an elongated electrode wire. Alternatively, the cleaning block may be positioned to clean adjacent or overlapping regions of the electrode with sequential cleaning passes. In some cases, the electrode is cleaned periodically with a single pass of the cleaning blocks. In some cases, the electrode is cleaned periodically with an initial pass and a return pass in a given conditioning cycle.

Figure 10:
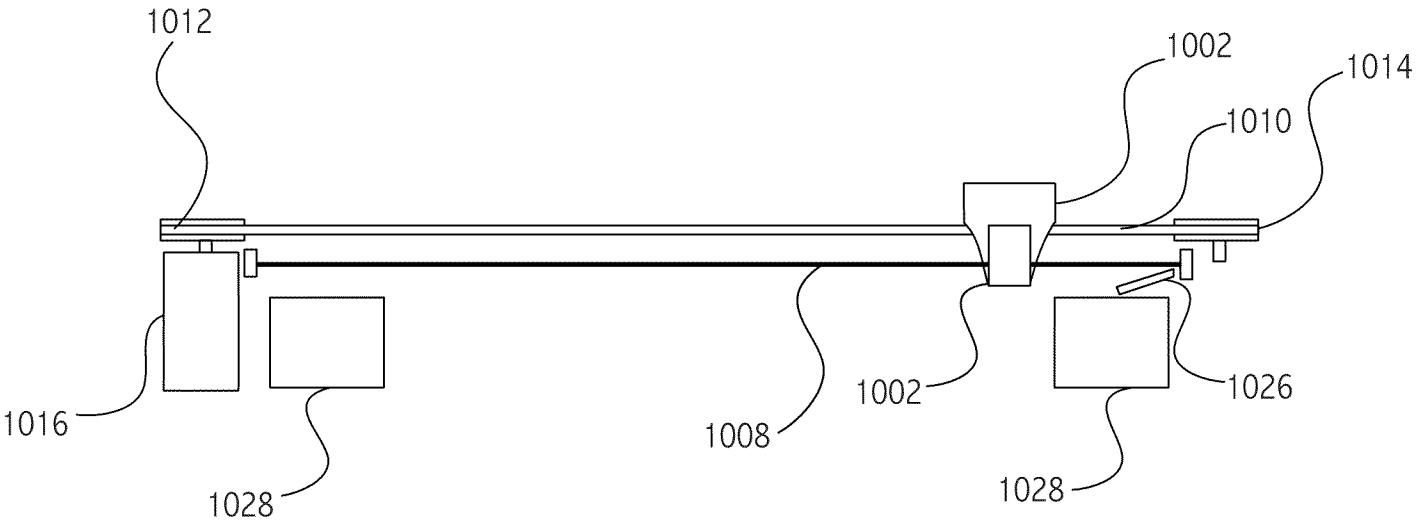
FIG. 10 illustrates a carriage for transiting the cleaning blocks along an electrode, in accordance with various implementations.

With reference to FIG. 10, an EFA or EHD device 1000 includes a carriage 1002 for transiting cleaning blocks along an electrode wire 1008. Carriage 1002 can be driven or translated via a drive cable 1010 trained about a drive pulley 1012 and idler pulley 1014, with drive pulley 1012 being rotatable by a drive motor 1016. Other types of drive mechanisms may be used to move carriage 1002 to thereby clean and/or condition an electrode. Carriage 1002 may be movable for single pass cleaning/conditioning such that carriage 1002 moves between alternate ends of electrode wire 1008 in each cycle. Alternatively, carriage 1002 may be movable to perform bidirectional cleaning including moving along the return path in a single cycle. Accordingly, any number of cleaning block movements may be employed to remove dendrites or other detrimental material from electrode wire 1008 or to otherwise condition electrode wire 1008. Similarly, carriage 1002 may be driven at a desired speed to effect cleaning and conditioning of electrode wire 1008.

In a particular case, an electrode wire is placed in tension, e.g., 20 g, and is cleaned using grooved carbon cleaning blocks (like those shown in FIG. 2), with an 80 g preload between the cleaning blocks. The carriage carrying the cleaning blocks is transited along the electrode wire at about 13 mm/s in both an initial pass and a return pass. In various implementations, varying degrees of electrode tension and cleaning block speeds may be employed. For example, cleaning blocks having a softer wiper surface, e.g., felt, may employ a higher block preload, e.g., 350 g. Dendrites can form on the electrode wire in a relatively short period of operation, 30-120 minutes, potentially affecting the performance of the electrode. Accordingly, cleaning may be advantageously initiated as a function of time, detection of dendrite growth, or in response to various events, e.g., power cycles or arcing.

Carriage 1002 can carry multiple cleaning block pairs positioned to clean multiple electrodes. Device 1000 can further include grounding electrodes, repelling electrodes, backflow electrodes or other electrodes arranged to motivate air through the device to exhaust heat delivered, e.g., from a heat sink via a heat pipe. Carriage 1002 may be fitted with additional cleaning mechanisms to be transited past any number of electrodes, filters, or other system features prone to accumulation of detrimental material or in need of mechanical conditioning.

With continued reference to FIG. 10, dendrite material or other detrimental material may accumulate on the cleaning block surfaces or adjacent carriage surfaces during cleaning and conditioning of electrode 1008. A brush 1026 or other secondary cleaning device is positioned near an end of the travel path of carriage 1002 to remove accumulated detrimental material from carriage 1002. Brush 1026 is positioned to contact the cleaning blocks and/or carriage leading surfaces.

In this particular implementation, brush 1026 is positioned along an end portion of the path of travel of carriage 1002 such that advancement of carriage 1002 against brush 1026 causes brush 1026 to deflect and to thereby wipe across the affected area of the blocks and/or carriage 1002. In some implementations, other mechanisms may be used to dislodge detrimental material that accumulates on the cleaning device surfaces or carriage surfaces during electrode cleaning or conditioning operations. Brush 1026 may be positioned outside of an airflow path.

The detrimental material dislodged by brush 1026 can be accumulated in a receptacle area 1028, which can be positioned adjacent where the carriage is stowed between cleaning cycles. Passages (not shown) in the receptacle area 1028 can be provided to allow escape of the dislodged detrimental material from the system, for example, upon tipping of the system during transport. In some cases, the receptacle area 1028 may include a removable bin. Still in some implementations, passages are provided below the electrode wire such that dislodged detrimental material simply falls out of the electronic device, e.g., as a fine powder through vents in a lower surface.

Figure 11:
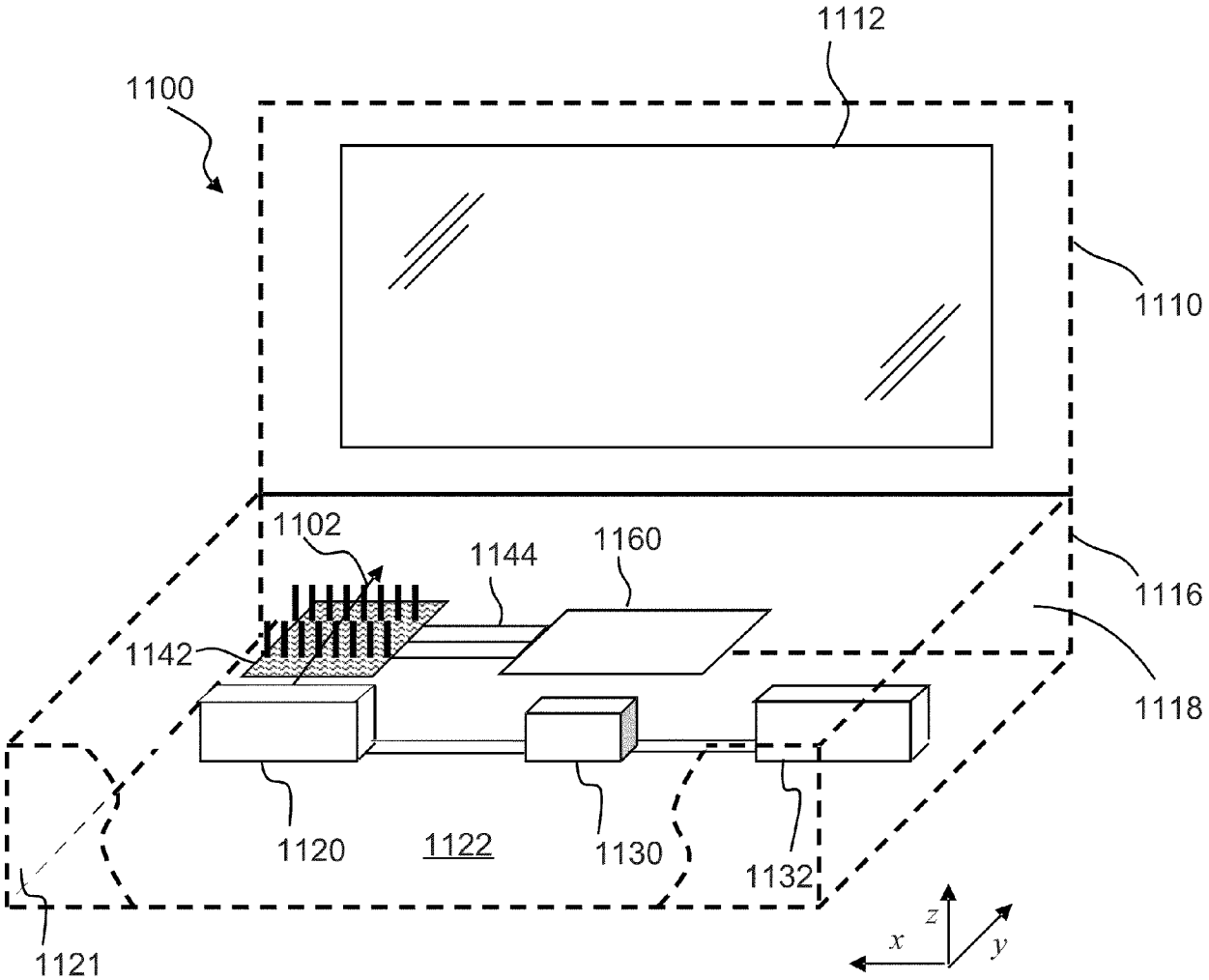
FIG. 11 depicts an electronic system using various implementations as described herein.

FIG. 11 is a schematic block diagram illustrating one implementation of an environment in which cleaning mechanism may operate. An electronic device 1100 such as a computer includes an EFA or EHD air cooling system 1120. Electronic device 1100 comprises a substantially rectangular housing 1116, or case, having a cover 1110 that includes a display device 1112. A portion of the front surface 1121 of housing 1116 has been cut away to reveal interior 1122. Housing 1116 of electronic device 1100 may also comprise a top surface (not shown) that supports one or more input devices that may include, for example, a keyboard, touchpad and tracking device. Electronic device 1100 further comprises electronic circuit 1160 which generates heat in operation. A thermal management solution comprises a heat pipe 1144 that draws heat from electronic circuit 1160 to heat sink device 1142.

Device 1120 is powered by high voltage power supply 1130 and is positioned proximate to heat sink 1142. Electronic device 1100 may also comprise many other circuits, depending on its intended use; to simplify illustration of this second implementation, other components that may occupy interior area 1122 of housing 1120 have been omitted from FIG. 11.

With continued reference to FIG. 11, in operation, high voltage power supply 1130 is operated to create a voltage difference between emitter electrodes and collector electrodes disposed in device 1120, generating an ion flow or stream that moves ambient air toward the collector electrodes. The moving air leaves device 1120 in the direction of arrow 1102, traveling through the protrusions of heat sink 1142 and through an exhaust grill or opening (not shown) in the rear surface 1118 of housing 1116, thereby dissipating heat accumulating in the air above and around heat sink 1142. Note that the position of illustrated components, e.g., of power supply 1130 relative to device 1120 and electronic circuit 1160, may vary from that shown in FIG. 11.

A controller 1132 is connected to device 1120 and may use sensor inputs to determine the state of the air cooling system, e.g., to determine a need for cleaning electrodes. Alternatively, the cleaning may be initiated by controller 1132 on a timed or scheduled basis, on a system efficiency measurement basis or by other suitable methods of determining when to clean electrodes. For example, detection of electrode arcing or other electrode performance characteristics may be used to initiate movement of the cleaning mechanism to condition the electrode.

In some implementations, the cleaning or other conditioning is performed when the electrode is not in use. Alternatively, cleaning operations may be performed at timed intervals. In some cases, conditioning or cleaning may be initiated by controller 1132 based upon one or more of an imposed voltage level, a measured electrical potential, determination of the presence of a level of contamination by optical means, be detection of an event or performance parameter, or other methods indicating a benefit from mechanically cleaning the electrode.

Thus, the electrode(s) to be cleaned or conditioned can constitute at least a portion of a thermal management assembly thermally coupled to a heat dissipating device in an electronic device. At least one of the electrode and the cleaning device is moveable in response to detection of one of a low thermal duty cycle, power on cycle and a power off cycle of the electronic device. For example, a low CPU usage cycle may be an appropriate time to de-energize an electrode for cleaning/conditioning.

Some implementations of thermal management systems described herein employ EFA or EHD devices to motivate flow of a fluid, typically air, based on acceleration of ions generated as a result of corona discharge. Other implementations may employ other ion generation techniques and will nonetheless be understood in the descriptive context provided herein. Using heat transfer surfaces that may or may not be monolithic or integrated with collector electrodes, heat dissipated by electronics (e.g., microprocessors, graphics units, etc.) and/or other components can be transferred to the fluid flow and exhausted. Typically, when a thermal management system is integrated into an operational environment heat transfer paths (often implemented as heat pipes or using other technologies) are provided to transfer heat from where it is dissipated (or generated) to a location (or locations) within the enclosure where air flow motivated by an EFA or EHD device (or devices) flows over heat transfer surfaces.

In some implementations, an EFA or EHD air cooling system or other ion motive or flow generating device employing an electrode cleaning system may be integrated in an operational system such as a laptop or desktop computer, a projector or video display device, etc., other implementations may take the form of subassemblies. Various features may be used with different ion motive or flow generating devices including EFA and EHD devices such as air movers, film separators, film treatment devices, air particulate cleaners, photocopy machines and cooling systems for electronic devices such as computers, laptops and handheld devices.

While the forgoing represents a description of various implementations or implementations of the invention, it is to be understood that the claims below recite the features of the present invention, and that other implementations, not specifically described hereinabove, fall within the scope of the present invention.

What is claimed is:

1. An apparatus comprising:

an electrode energizable with respect to at least one other electrode to generate ions and thereby motivate fluid flow there between;

a cleaning device positioned to frictionally engage at least a portion of a surface of the electrode;

one of the cleaning device and the electrode being movable relative to the other to thereby remove detrimental material from the electrode; and an electrode conditioning material depositable on the electrode in situ via movement of the one of the cleaning device and the electrode.

2. The apparatus of claim 1, wherein the conditioning material is depositable via the cleaning device.

3. The apparatus of claim 1, wherein the conditioning material is depositable via one of a wearable layer, wearable pad, and wearable insert on the cleaning device.

4. The apparatus of claim 1, wherein the cleaning device comprises first and second opposing cleaning blocks in contact with the electrode.

5. The apparatus of claim 4, wherein at least one of the first and second cleaning blocks defines a substantially nonlinear electrode guide to thereby elastically deform the electrode during movement of one of the cleaning device and the electrode.

6. The apparatus of claim 1, wherein the electrode is one of an emitter electrode and a collector electrode.

7. The apparatus of claim 1, further comprising the other electrode and wherein the other electrode is one of an emitter electrode and a collector electrode.

8. The apparatus of claim 1, wherein the conditioning material includes an ozone reducer.

9. The apparatus of claim 1, wherein at least a leading portion of the cleaning device is constructed to clean the electrode and at least a trailing portion of the cleaning device comprises a wearable bulk of conditioning material.

10. The apparatus of claim 1, wherein the cleaning device comprises the conditioning material in contact with the electrode, the conditioning material having a hardness selected to be wearable in contact with the electrode to provide a layer of conditioning material on a surface of the electrode and to remove detrimental material from the electrode without substantially abrading the electrode.

11. The apparatus of claim 1, wherein the Rockwell hardness of the conditioning material is less than about 60 percent of a Rockwell hardness of the electrode.

12. The apparatus of claim 1, wherein the conditioning material is selected to at least partially mitigate at least one of electrode erosion, corrosion, oxidation, silica adhesion, dendrite formation and ozone production.

13. The apparatus of claim 1, wherein the conditioning material includes at least one of silver, palladium, platinum, manganese, nickel, zirconium, titanium, tungsten, aluminum, oxides or alloys thereof.

14. The apparatus of claim 1, wherein the cleaning device defines one or more channels bearing the conditioning material.

15. The apparatus of claim 1, wherein the conditioning material comprises multiple regions with different conditioning compositions.

16. The apparatus of claim 1, wherein the conditioning material comprises at least one of wax, gel, polymer, carbon, and organometallic material that decomposes under plasma conditions.

17. The apparatus of claim 1, wherein at least one of the electrode and the cleaning device is moveable in response to one of detection of an event and a change in measured device operating parameters.

18. The apparatus of claim 17, wherein the electrode and the other electrode constitute at least a portion of a thermal management assembly thermally coupled to a heat dissipating device in an electronic device.

19. The apparatus of claim 18, wherein at least one of the electrode and the cleaning device is moveable in response to detection of one of a low thermal duty cycle, power on cycle and a power off cycle of the electronic device.

20. A method of conditioning an electrode in an ion generating system, the method comprising:

positioning a cleaning device to frictionally engage at least a portion of a surface of the electrode;

moving at least one of the cleaning device and the electrode to thereby remove detrimental material from the electrode; and depositing, in situ, an electrode conditioning material on the electrode.

21. The method of claim 20, wherein the electrode conditioning material includes an ozone reducer.

22. The method of claim 20, wherein the deposited conditioning material forms a sacrificial coating selected to mitigate electrode oxidation.

23. The method of claim 20, wherein the applying comprises providing the conditioning material in contact with the electrode during the moving.

24. The method of claim 20, wherein the conditioning material is deposited by the cleaning device via movement of at least one of the cleaning device and the electrode.

25. The method of claim 20, wherein the conditioning material comprises a liquid supplied to the cleaning device during the moving.

26. The method of claim 25, wherein the conditioning material is a wearable material disposed on the cleaning device.

27. The method of claim 20, wherein depositing the conditioning material comprises wicking the conditioning material onto a surface of the electrode.

28. The method of claim 27, further comprising heating the electrode during the wicking.

29. The method of claim 20, wherein the conditioning material is selected to mitigate at least one of electrode surface erosion, corrosion, oxidation, dendrite formation and ozone production.

30. The method of claim 20, further including heating the electrode using a power supply and controller to modify at least one of a composition, phase, morphology and surface adhesion of a deposited conditioning material.

31. The method of claim 20, wherein the conditioning material includes at least one of silver, palladium, platinum, manganese, nickel, zirconium, titanium, tungsten, aluminum, oxides or alloys thereof.

32. An apparatus comprising:

a fluid motive device comprising:

a first electrode energizable with respect to at least one other electrode to generate ions and thereby motivate fluid flow therebetween;

a cleaning device positioned to frictionally engage at least a portion of a surface of the first electrode;

one of the cleaning device and the first electrode being movable relative to the other to thereby remove detrimental material from the first electrode; and an electrode conditioning material depositable on the first electrode in situ via movement of the one of the cleaning device and the first electrode; and a controller operable to initiate movement of one of the cleaning device and the first electrode to thereby deposit the conditioning material on the first electrode.

33. The apparatus of claim 32, wherein the first electrode and the other electrode constitute at least a portion of a thermal management assembly thermally coupled to a heat dissipating device in an electronic device.

34. The apparatus of claim 33, wherein at least one of the first electrode and the cleaning device is moveable in response to detection of one of a low thermal duty cycle, power on cycle and a power off cycle of the electronic device.

35. The apparatus of claim 32, incorporated into one of a computing device, photocopier, printer, and air purifier.

* * * * *